US009486387B2

(12) United States Patent
Crowell et al.

(10) Patent No.: US 9,486,387 B2
(45) Date of Patent: Nov. 8, 2016

(54) MYOFASCIAL ROLLER WRAP

(71) Applicant: Hygenic Intangible Property Holding Co., Akron, OH (US)

(72) Inventors: Jason Crowell, Akron, OH (US); April Bertram, Canton, OH (US)

(73) Assignee: HYGENIC INTANGIBLE PROPERTY HOLDING COMPANY, Akron, OH (US)

( * ) Notice: Subject to any disclaimer, the term of this patent is extended or adjusted under 35 U.S.C. 154(b) by 0 days.

(21) Appl. No.: 14/475,460

(22) Filed: Sep. 2, 2014

(65) Prior Publication Data

US 2015/0133837 A1 May 14, 2015

Related U.S. Application Data

(63) Continuation of application No. 13/270,366, filed on Oct. 11, 2011, now Pat. No. 8,821,352.

(51) Int. Cl.

| | |
|---|---|
| ***A63B 21/00*** | (2006.01) |
| ***A61H 7/00*** | (2006.01) |
| ***A61H 15/00*** | (2006.01) |

(52) U.S. Cl.

CPC ..... *A61H 7/00* (2013.01); *A61H 15/0092* (2013.01); *A61H 2015/0014* (2013.01); *A61H 2201/1685* (2013.01)

(58) Field of Classification Search

CPC ..... A63B 21/00

USPC ..... 482/49, 11, 109; 601/120, 121; 15/207.2

See application file for complete search history.

(56) References Cited

U.S. PATENT DOCUMENTS

| | | | | |
|---|---|---|---|---|
| 4,955,914 | A * | 9/1990 | Caniglia et al. | 606/235 |
| 5,300,001 | A * | 4/1994 | Sealy | A63B 21/0602 128/DIG. 15 |
| 6,248,043 | B1 * | 6/2001 | Morton | 482/11 |
| 6,398,694 | B1 * | 6/2002 | Bountourakis | A63B 21/00069 482/109 |
| D693,934 | S * | 11/2013 | Lin | D24/215 |
| 9,005,146 | B2 | 4/2015 | Phillips | |
| 2006/0112509 | A1 * | 6/2006 | Merten | B05C 17/0207 15/207.2 |

* cited by examiner

*Primary Examiner* — Jerome w Donnelly

(74) *Attorney, Agent, or Firm* — Baker and Hostetler LLP

(57) ABSTRACT

The present invention provides in some embodiments, a cover for an exercise roller. The cover can include an elongate tubular structure defining a generally cylindrical elongate lumen extending through the length of the elongate tubular structure. A wall of the cover can have an inner face surrounding the generally cylindrical elongate lumen, which is configured to surround an outer surface of the exercise roller. The outer face of the elongate tubular structure can have a textured surface, and the elongate tubular structure has a density configured for myofascial release. Additionally, the inner face of the wall and the outer face of the wall define a thickness of the cover for an exercise device.

12 Claims, 5 Drawing Sheets

MYOFASCIAL ROLLER WRAP

CROSS-REFERENCE TO RELATED APPLICATIONS

The application is a Continuation application of U.S. patent application Ser. No. 13/270,366 filed Oct. 11, 2011, the disclosure of which is incorporated herein by reference in its entirety.

FIELD OF THE INVENTION

The present invention generally relates to a therapeutic device. More particularly, the present invention pertains to a wrap for an exercise roller for treating a person's musculature.

BACKGROUND OF THE INVENTION

Massage has long been used to treat tight, stiff, and injured muscles, because benefits, such as prevention and prediction of muscle injuries, improvement of strength, flexibility, and endurance, dispersal of lactic acid, and accelerated recovery, are numerous. Athletes and exercise aficionados have long turned to massage to improve performance and ease aching muscles. Using a licensed massage therapist each time massage would be beneficial, but could easily become prohibitively expensive. Additionally, there are times when immediate treatment is necessary. Physical therapists and athletic trainers also frequently turn to tools in training and rehabilitating clients. Having variety in these tools can help to rehabilitate a clients muscles and/or enhance athletic performance.

Therefore, massage devices were developed to address these needs. Massage devices can also often used to treat trigger points. One type of massage device is a roller that can be rolled between a person's muscles and a flat surface, in order to treat the ailments and provide the improvements described above. These rollers are generally made of plastic, foam, or rubber, and the rollers currently on the market can have a smooth or a textured surface. Unfortunately, these devices do not offer any variety in surface texture, density, or size, unless a user buys multiple products, and therefore, cannot treat an array of muscle problems with a single device.

It is therefore desirable to provide a roller device capable of providing a progression of treatment options in a single device.

SUMMARY OF THE INVENTION

The foregoing needs are met, to a great extent, by the present invention, wherein in some embodiments a myofascial roller wrap that is capable of overcoming the disadvantages described herein at least to some extent is provided.

In accordance with an embodiment of the present invention, a cover for an exercise device includes an elongate tubular structure having a longitudinal axis and having a wall defining a generally cylindrical elongate lumen extending through the length of the elongate tubular structure. The wall can have an inner face surrounding the generally cylindrical elongate lumen. The inner face can be configured to surround an outer surface of the exercise device. The wall can also have an outer face opposite the inner face and the outer face of the elongate tubular structure can have a textured surface. The elongate tubular structure can also have a density configured for myofascial release, and the inner face of the wall and the outer face of the wall can define a thickness of the cover.

In accordance with another aspect of the present invention, an adapter set for an exercise device can include multiple covers, each having a longitudinal axis and each having an wall that can be wrapped around the exercise device, and having an generally cylindrical elongate lumen extending through the length of the cover. The wall can have an inner face surrounding the generally cylindrical elongate lumen, which is configured to surround an outer surface of the exercise device. The wall can also have an outer face opposite the inner face. Each of the covers can have a density configured for myofascial release. Also, the inner face of the wall and the outer face of the wall define a thickness, such that the cover generally increases a diameter of the exercise device.

In accordance with still another aspect of the present invention, the density of the cover can be configured for the myofascial release of a predetermined body part, and the textured surface can also be configured to provide myofascial release. If the cover includes a textured surface, the textured surface can include ridges each ridge having a longitudinal axis extending parallel to the longitudinal axis of the elongate tubular structure. Alternately, the textured surface contains a combination of raised surface patterns. The cover can be formed from at least one of a plastic, rubber, thermoplastic elastomers, or foam. The tubular structure of the cover can be formed by wrapping the cover around the exercise device, and the tubular structure can be secured after wrapping by using a fabric hook and loop fastener.

In accordance with even another aspect of the present invention, a method of providing progressive myofascial release can include providing multiple wraps for covering an exercise device each having a predetermined thickness and configured for myofascial release. The method can also include covering the exercise device with one of the multiple wraps to create a device for myofascial release. Another step can include treating an individual with the one of the multiple roller wraps having a first density. In addition, the method can include substituting the one of the multiple wraps with another one of the multiple wraps and creating a progression of myofascial release by treating an individual with the another one of the multiple roller wraps.

In accordance with yet another aspect of the present invention, the method can include at least one of the multiple roller wraps having a textured surface. The textured surface can be distinct for each subsequent roller wrap. Alternately, the progression can be created by substituting the one of the multiple wraps with another one of the multiple wraps and varying at least one of the surface texture, the density, or the thickness between the one of the multiple wraps and the another one of the multiple wraps.

There has thus been outlined, rather broadly, certain embodiments of the invention in order that the detailed description thereof, herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

The present invention provides in some embodiments, a cover for an exercise roller. The cover can include an elongate tubular structure defining a generally cylindrical elongate lumen extending through the length of the elongate tubular structure. A wall of the cover can have an inner face surrounding the generally cylindrical elongate lumen, which is configured to surround an outer surface of the exercise roller. The outer face of the elongate tubular structure can have a textured surface, and the elongate tubular structure has a density configured for myofascial release. Additionally, the inner face of the wall and the outer face of the wall define a thickness of the cover for an exercise device. The invention can also include a method of using a progression of covers having different densities, thicknesses, and textures to provide myofascial release.

Figure 1:
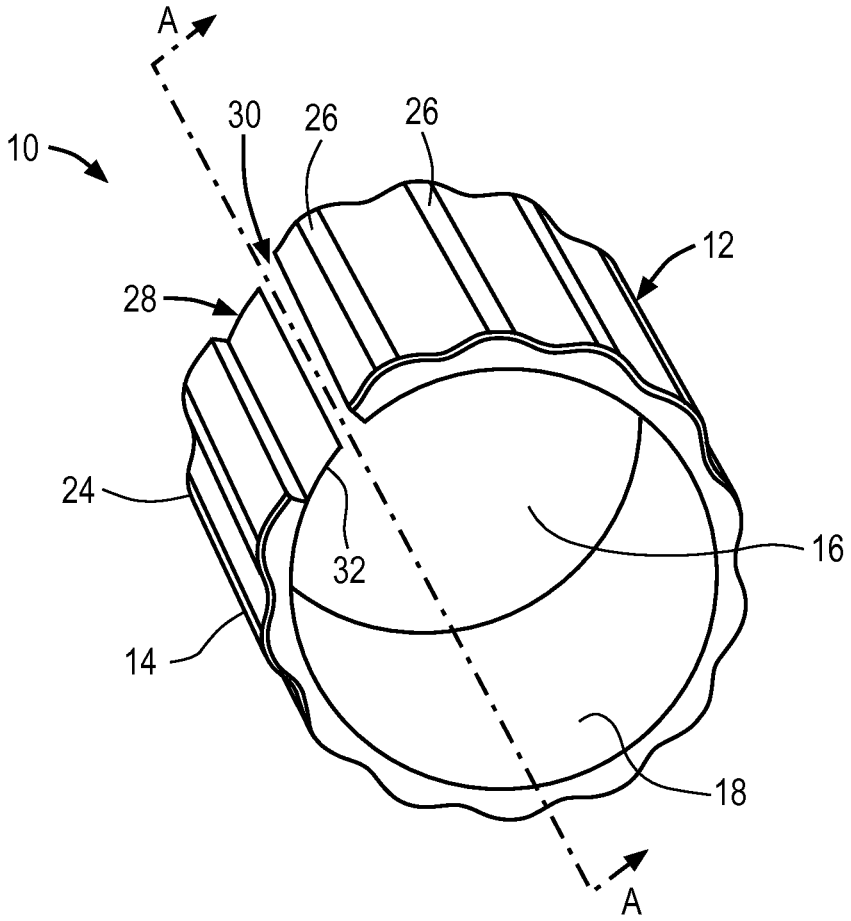
FIG. 1 illustrates a perspective view of a myofascial roller wrap in accordance with an embodiment of the invention.
Figure 2:
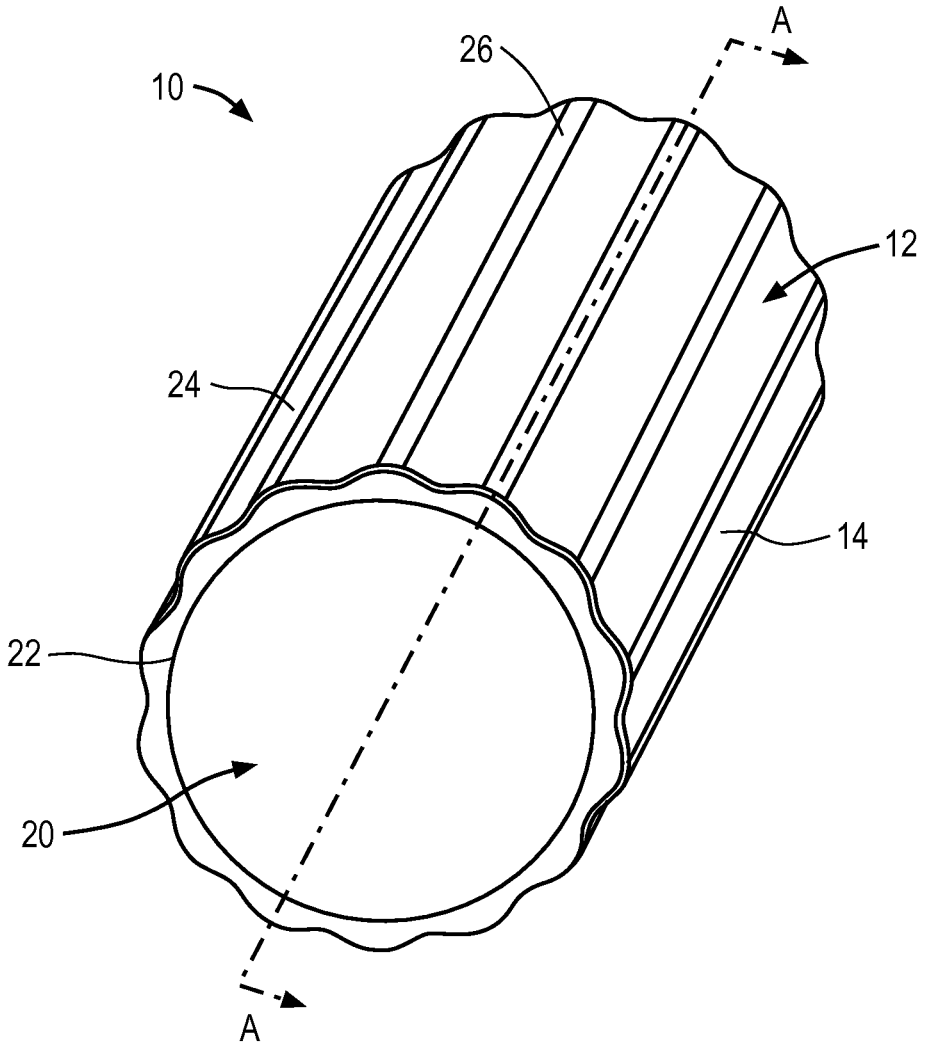
FIG. 2 illustrates a perspective view of a myofascial roller wrap secured around the outside of a roller, in accordance with an embodiment of the invention.
Figure 3A:
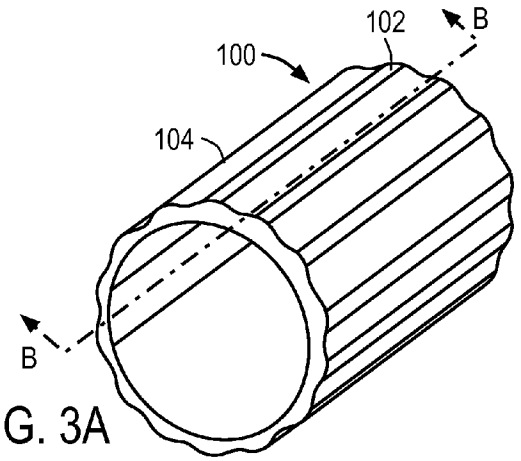
FIGS. 3A-3D illustrate myofascial roller wraps in accordance with an embodiment of the invention.
Figure 3B:
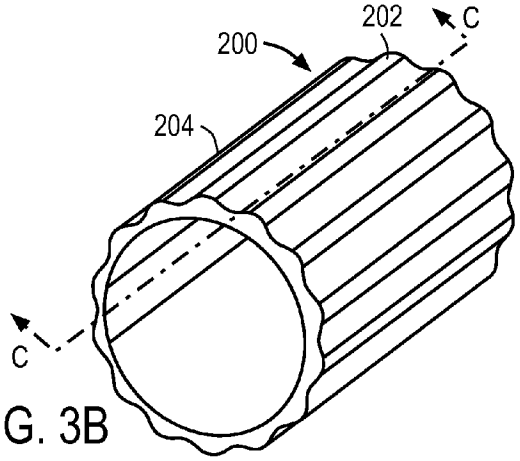
Figure 3C:
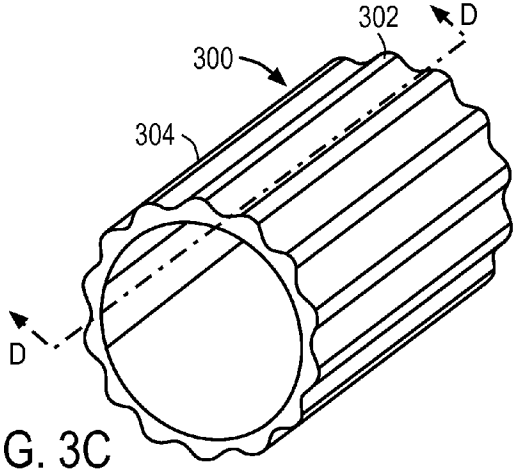
Figure 3D:
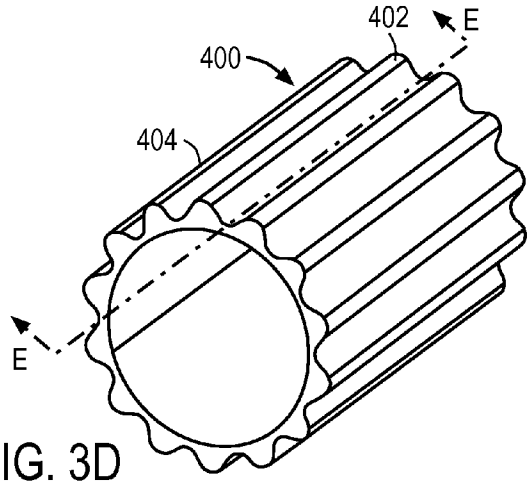
Figure 4A:
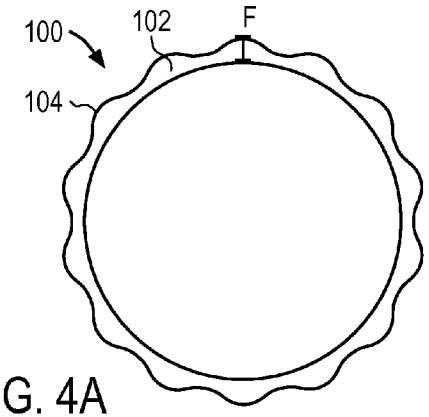
FIGS. 4A-4D illustrate a sectional view of the myofascial roller wraps illustrated in FIGS. 3A-3D in accordance with an embodiment of the invention.
Figure 4B:
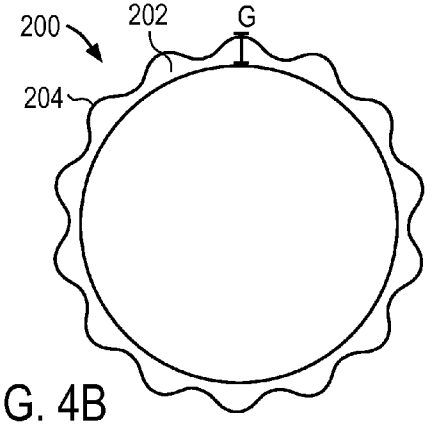
Figure 4C:
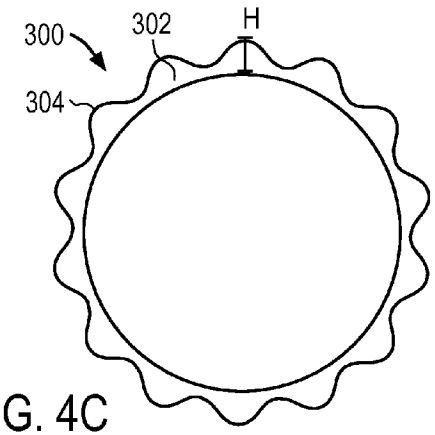
Figure 4D:
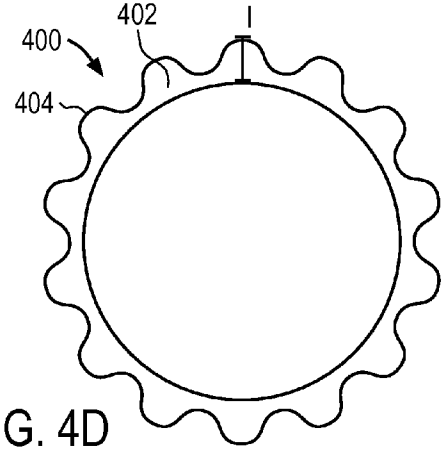

The invention will now be described with reference to the drawing figures, in which like reference numerals refer to like parts throughout. FIG. 1 illustrates a view of a myofascial roller wrap device 10 and FIG. 2 illustrates the myofascial roller wrap of FIG. 1 wrapped around an exercise roller, in accordance with an embodiment of the present invention. The myofascial roller wrap 10 has an elongate tubular structure 12, having a longitudinal axis "A." The elongate tubular structure 12 can be created by a wall 14. The wall 14 defines a generally cylindrical elongate lumen 16 extending through the length of the elongate tubular structure 12. As illustrated in FIG. 1, the wall 14 can have an inner face 18 surrounding the generally cylindrical elongate lumen 16. The inner face 18 can be configured to surround an outer surface 20 of exercise device 22, as illustrated in FIG. 2.

The wall 14 can also include an outer face 24 opposite the inner face 18. The outer face 24 can include a textured surface that can be configured to provide myofascial release. As illustrated in FIGS. 1 and 2, the texture can take the form of ridges 26 that extend parallel to the longitudinal axis "A" of the myofascial roller wrap. This example of surface texture is not meant to be limiting and the texture can take any form suitable for effective myofascial release. The texture can also be configured to cover all of or just a portion of the outer face 24 of the roller wrap 10. Additionally, the wall 14 of the roller wrap 10 can be formed from any suitable material such as plastic, rubber, thermoplastic elastomer, or foam.

As illustrated in FIG. 1, the wall 14 can also include a first end 28 and a second end 30. The first end 28 can include a piece of fabric hook and loop fastener 32 extending along the length of the wall 14 in a direction parallel to the longitudinal axis "A" of the roller wrap 10. The second end 30 can also include a corresponding piece of the fabric hook and loop fastener (not shown). The roller wrap 10 can then be wrapped around the exercise device 22 and secured using the fabric hook and loop fasteners. The roller wrap 10 is shown in FIG. 2 wrapped around exercise device 22 and secured. This, of course is not the only way the roller wrap can be secured around the exercise device 22. Any suitable method of securing the roller wrap 10 can be used. Alternately, the roller wrap can be extruded in a continuous tube having no seam. This type of roller wrap could be held in place on the exercise device frictionally.

FIGS. 3A-3D illustrate different textures for an outer surface of a myofascial roller wrap in accordance with an embodiment of the invention, and FIGS. 4A-4D show a sectional view of the myofascial roller wraps illustrated in FIGS. 3A-3D. As illustrated in FIGS. 3A-3D and 4A-4D the roller wraps 100, 200, 300, and 400 include ridges 102, 202, 302, and 402 extending along a surface 104, 204, 304, 404 of the roller wraps 100, 200, 300, and 400. The ridges 102, 202, 302, and 402 extend parallel to a longitudinal axis "B," "C," "D," and "E" of each of the respective wraps The different surface textures illustrated in these figures are not to be considered limiting, but are simply examples of various surface textures that can be used for the roller section. These textures can also be combined on a single myofascial roller wrap. Additionally, other factors can be changed in order to create a progression for the myofascial roller wraps. For instance, the depth of the texture on the surface of the roller wrap can be increased or decreased to create a different degrees of treatment. This progression of height can be seen in FIGS. 4A-4D, as the heights "F," "G," "H," and "I" of ridges 102, 202, 302, and 402 increase from FIG. 4A to FIG. 4D.

The material used to form the roller sections can also be changed. For example, the density of the material can be increased or decreased in order to provide different degrees of treatment. The thickness of the material and the material itself can also be varied. For instance a progression could start with a soft foam in a series of materials with progressing hardness and could end with a cover made from a harder plastic material. The examples discussed above are merely examples and are not to be considered limiting. The roller sections can be provided in any combination of material and surface texture appropriate for providing the desired treatment.

For instance, in another example, a progression could include a first roller wrap having low ridges. A second roller wrap could have low ridges but could be formed from a material with a higher density. A third roller wrap could include a wrap having deeper ridges but being formed from a material with a lower density than the second roller wrap but a higher density than the first roller wrap. Therefore, almost endless combinations of roller wraps could be used to effect myofascial release in a user.

Figure 5:
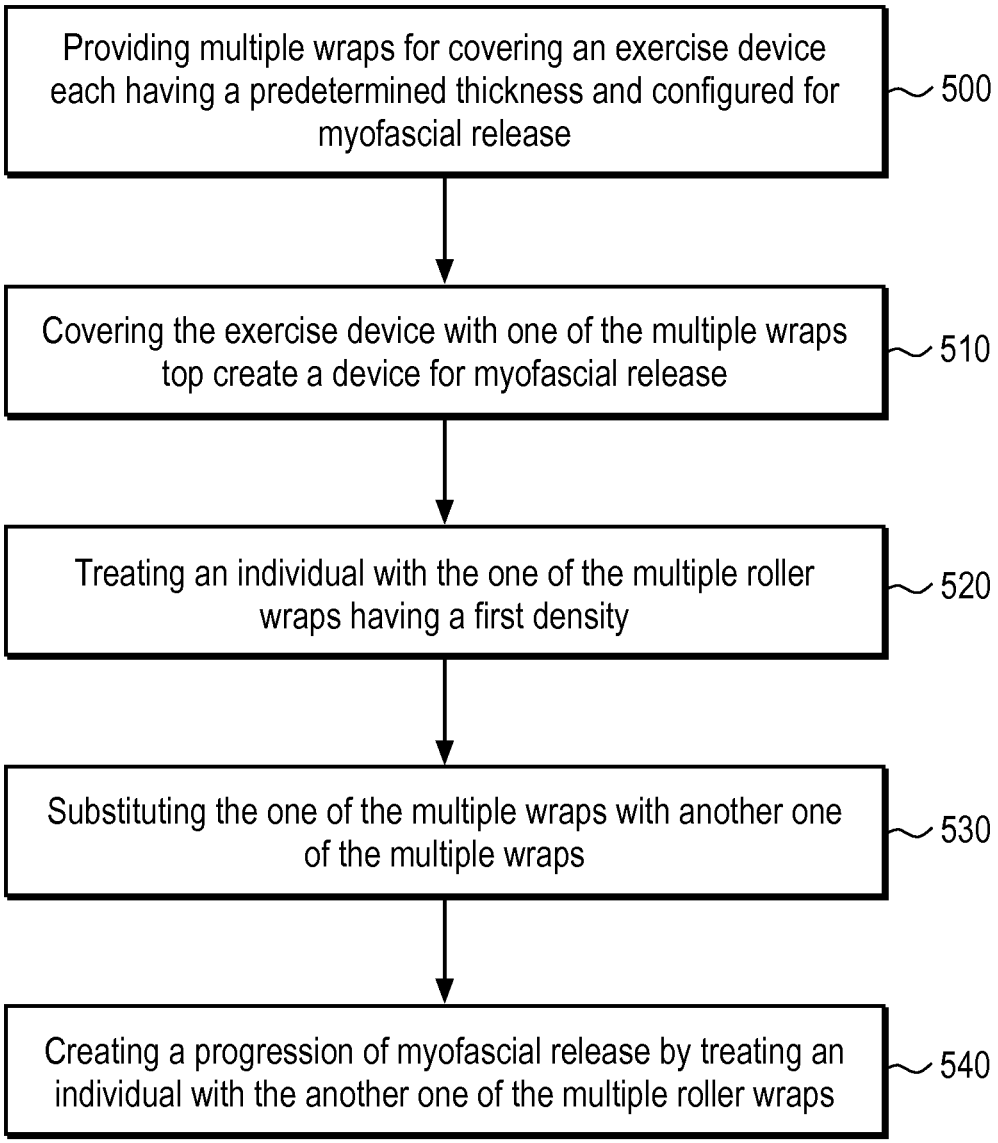
FIG. 5 illustrates a diagram of a method of using a progression of myofascial roller wraps in accordance with an embodiment of the present invention.

FIG. 5 illustrates a diagram showing a method of using a progression of myofascial roller wraps in accordance with an embodiment of the invention. The method can include a step 500 of providing multiple wraps for covering an exercise device each having a predetermined thickness and configured for myofascial release. Step 510 can include covering the exercise device with one of the multiple wraps to create a device for myofascial release. The method can also include step 520 of treating an individual with the one of the multiple roller wraps having a first density and step 530 of substituting the one of the multiple wraps with another one of the multiple wraps. Additionally, the method can include step 540 of creating a progression of myofascial release by treating an individual with the another one of the multiple roller wraps. The method can further include that the progression is created by substituting the one of the multiple wraps with another one of the multiple wraps and varying at least one of the surface texture, the density, or the thickness between the one of the multiple wraps and the another one of the multiple wraps.

The many features and advantages of the invention are apparent from the detailed specification, and thus, it is intended by the appended claims to cover all such features and advantages of the invention which fall within the true spirit and scope of the invention. Further, because numerous modifications and variations will readily occur to those skilled in the art, it is not desired to limit the invention to the exact construction and operation illustrated and described, and accordingly, all suitable modifications and equivalents may be resorted to falling within the scope of the invention.

What is claimed is:

1. A roller wrap for an exercise device, the roller wrap comprising:

an elongated structure including a wall extending in a longitudinal direction, the wall having an inner face surface and an outer face surface, opposite the inner face surface, wherein the wall includes a first end extending parallel to the longitudinal axis and a second end extending parallel to the longitudinal axis, wherein the outer face surface is a textured surface, wherein the inner face surface is configured to wrap around an outer surface of the exercise device, and wherein the textured surface comprises a plurality of ridges extending from a first longitudinal end of the elongate tubular structure to a second longitudinal end of the elongate tubular structure.

2. The roller wrap for an exercise device of claim 1, wherein the first end and the second end overlap and are secured to one another.

3. The roller wrap for an exercise device of claim 2, wherein the first end and the second end are secured to one another via a hook and loop fastener.

4. The roller wrap for an exercise device of claim 1, wherein the elongated structure defines a generally cylindrical elongate lumen when the first end and the second end overlap one another.

5. A roller wrap for an exercise device, the roller wrap comprising:

an elongated structure including a wall extending in a longitudinal direction, the wall having an inner face surface and an outer face surface, opposite the inner face surface, wherein the wall includes a first end extending parallel to the longitudinal axis and a second end extending parallel to the longitudinal axis, wherein the outer face surface is a textured surface, wherein the inner face surface is configured to wrap around an outer surface of the exercise device, wherein the textured surface comprises a plurality of ridges extending parallel to the longitudinal axis and a valley disposed between each pair of ridges of the plurality of ridges, and wherein the valley defines a concave surface.

6. A roller wrap for an exercise device, the roller wrap comprising:

an elongated structure including a wall extending in a longitudinal direction, the wall having an inner face surface and an outer face surface, opposite the inner face surface, wherein the wall includes a first end extending parallel to the longitudinal axis and a second end extending parallel to the longitudinal axis, wherein the outer face surface is a textured surface, wherein the inner face surface is configured to wrap around an outer surface of the exercise device, and wherein the textured surface contains a combination of raised surface patterns.

7. The roller wrap for an exercise device of claim 5, wherein the first end and the second end overlap and are secured to one another.

8. The roller wrap for an exercise device of claim 7, wherein the first end and the second end are secured to one another via a hook and loop fastener.

9. The roller wrap for an exercise device of claim 5, wherein the elongated structure defines a generally cylindrical elongate lumen when the first end and the second end overlap one another.

10. The roller wrap for an exercise device of claim 6, wherein the first end and the second end overlap and are secured to one another.

11. The roller wrap for an exercise device of claim 10, wherein the first end and the second end are secured to one another via a hook and loop fastener.

12. The roller wrap for an exercise device of claim 6, wherein the elongated structure defines a generally cylindrical elongate lumen when the first end and the second end overlap one another.

* * * * *